United States Patent [19]

Brennan et al.

[11] 3,930,538

[45] Jan. 6, 1976

[54] WELLPOINT WITH ADJUSTABLE VALVE

[75] Inventors: Walter W. Brennan; Charles R. Myers; Paul E. Perry, all of Jacksonville, Fla.

[73] Assignee: Griffin Wellpoint Corporation, New York, N.Y.

[22] Filed: Nov. 5, 1974

[21] Appl. No.: 521,029

[52] U.S. Cl. ..... 166/205

[51] Int. Cl.[2] ..... E03B 3/18; E21B 43/02

[58] Field of Search ..... 166/205, 157, 158; 137/544; 210/429, 430

[56] References Cited

UNITED STATES PATENTS

| | | | |
|---|---|---|---|
| 2,359,717 | 10/1944 | Myers | 166/205 |
| 2,780,293 | 2/1957 | Zandmer | 166/205 |
| 2,891,623 | 6/1959 | Boss | 166/205 |

*Primary Examiner*—James A. Leppink
*Attorney, Agent, or Firm*—William D. Stokes

[57] ABSTRACT

A wellpoint having an outer screen pipe, and an inner intake pipe connected to a vacuum source. A positionable valve is mounted between the screen pipe and the intake pipe to regulate the amount of screen pipe surface subject to vacuum by the intake pipe.

6 Claims, 3 Drawing Figures

WELLPOINT WITH ADJUSTABLE VALVE

BACKGROUND OF THE INVENTION

This invention relates in general to wellpoints for tapping subterranean liquid levels. More specifically, the invention pertains to a wellpoint employing an outer screen pipe and an inner, vacuum producing intake pipe.

This particular wellpoint configuration has proven highly advantageous. However, the output of such a configuration has been adversely affected when the input of liquid from the screen pipe to the intake pipe has fallen below the capacity of the intake pipe. The intake pipe then draws in free air as well as liquid, resulting in reduced pumping efficiency.

It is, therefore, an object of this invention to provide an improved wellpoint.

It is an additional object of the invention to provide a wellpoint wherein the introduction of free air into the intake pipe is prevented.

It is another object of the invention to improve the pumping efficiency of a wellpoint having an intake pipe and outer screen pipe.

It is another object of the invention to provide a wellpoint including means for selectively reducing the area of screen pipe subjected to vacuum by an intake pipe.

SUMMARY OF THE INVENTION

These and other objects and advantages of the invention are accomplished in a wellpoint including a slotted outer screen pipe and an inner vacuum producing intake pipe by slidably mounting a valve member on the intake pipe. The valve member is positionable along the inner pipe and shaped to conform to the space between the inner and outer screen pipes. In use, the position of the valve member is adjusted to subject as much of the slotted screen to the intake pipe vaccum as possible.

DETAILED DESCRIPTION OF THE PREFERRED EMBODIMENT OF THE INVENTION

Figure 1:
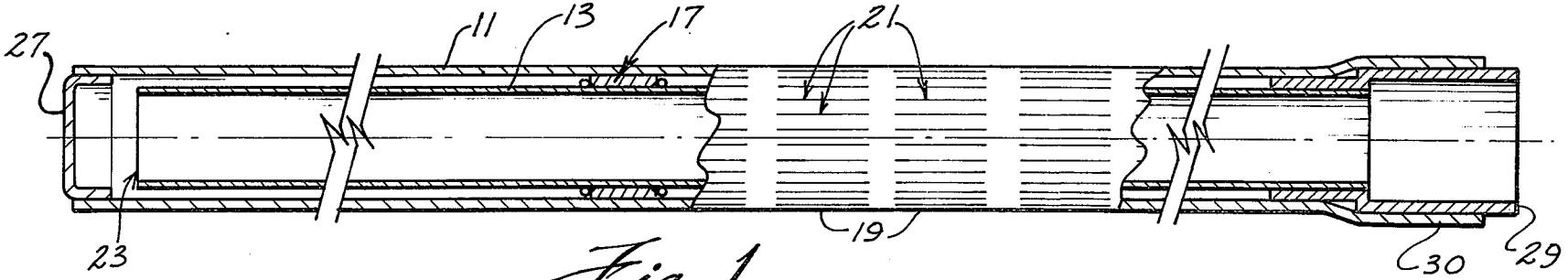
FIG. 1 is a view of the wellpoint of the preferred embodiment of the invention taken on a cross section along its length.

As seen in FIG. 1, the preferred embodiment of the wellpoint of the invention includes an outer cylindrical screen pipe 11, an intake pipe 13, which is concentric with the screen 11, and a slidable valve assembly 17. The screen 11 has successive rows 19 of slots 21 along its entire length. When set into a well hole, the screen 11 is thus capable of admitting liquid through the slots 21 into the interior of the wellpoint for intake at the mouth 23 of the intake pipe 13. The screen 11 additionally is sealed at one end preferably by a welded plug 27. The intake pipe 13 has a bushing 29 welded thereon, which sets into the top 30 of the screen pipe 13. The intake pipe bushing 29 positions the intake pipe 13 while permitting its removal from the screen pipe 11. Beyond the bushing 29, the intake pipe 13 is connected to a pumping means 32, which creates a vacuum in the intake pipe 13, as known in the prior art.

The wellpoint as thus far described, without the slidable valve assembly 17, has proven highly advantageous, particularly as a result of the long, continuously slotted screen pipe 11, which enables maximum access to surrounding liquids. However, when the water yield of the screen pipe 11 becomes less than the capacity of the intake pipe 13, free air enters the intake pipe 13. The result is a lower vacuum in the pumping system and a lower pressure differential forcing the ground fluid through the screen pipe 11. Hence, the yield of the wellpoint is adversely affected.

Figure 3:
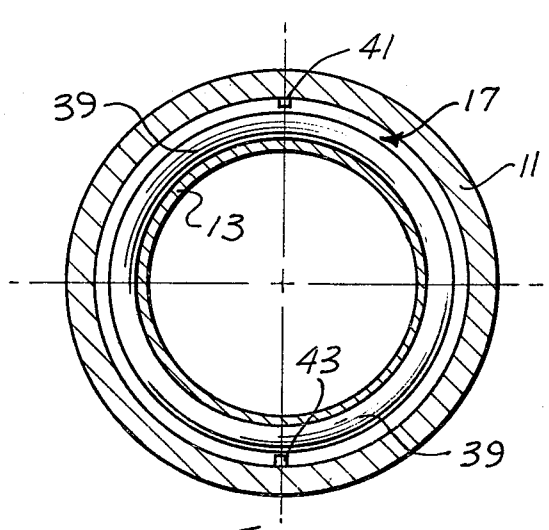
FIG. 3 is a cross section along a plane parallel to the circumference of the wellpoint of the preferred embodiment of the invention.
Figure 2:
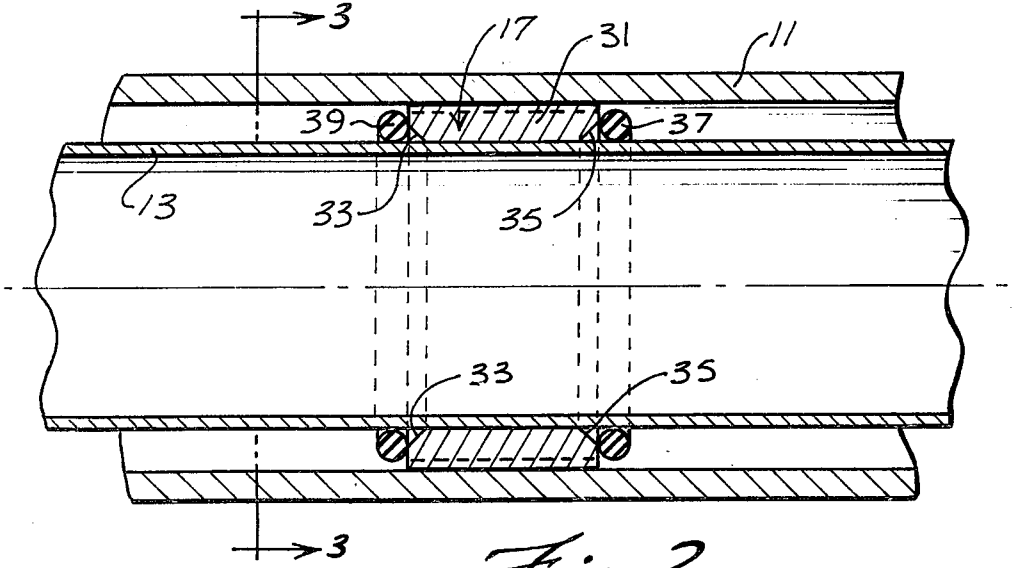
FIG. 2 is a detailed view of the valve means of the preferred embodiment of the invention.

To remedy this adverse effect, the valve assembly 17 is slidably mounted on the intake pipe 13. As shown in FIG. 2, the valve assembly 17 includes a cylindrical plastic or metal ring 31 having chamfered inner edges 33, 35 for retaining two O-rings 37, 39. As shown in FIG. 3, small grooves 41, 43 are provided at the outer diameter of the cylindrical ring 31 for providing drainage from the slots 21 located above the valve assembly 17. The O-rings 37, 39 and chamfered edges 33, 35 prevent movement of the valve in response to differential pressures set up by the vacuum created through the intake pipe 13.

In the preferred embodiment, the valve is positioned out of the ground by hand. Initially the wellpoint screen pipe 11, intake pipe 13 and valve assembly 17 are inserted into the ground to the desired depth. The valve assembly 17 is initially positioned according to an estimate of where it will function best, based upon known soil characteristics. After pumping has established that it would be best to raise or lower the valve assembly 17, the intake pipe 13 and valve assembly 17 are removed from the screen pipe 11, which remains in the ground. The valve is repositioned up or down the intake pipe 13, and the intake pipe 13 is then reinserted into screen pipe 11. The removal of the intake pipe 13 and adjustment of the slidable valve assembly 17 is a simple and hence economical procedure. While adjustment of the valve without removal of the intake pipe 13 by "down the hole" tools is possible, such adjustment is economically undesirable and avoided in the preferred embodiment of the invention. With the valve assembly 17 properly in place the advantage of a long slotted screen pipe 11 is maintained while avoiding the deleterious passage of free air into the intake pipe 11.

Although this invention has been described with references to illustrative embodiments thereof, it will be apparent to those skilled in the art that the principles of this invention can be embodied in other forms but within the scope of the claims.

What is claimed is:

1. A wellpoint comprising:

pipe means for the intake of liquid from the well and connection to vacuum producing means;

screen means spaced apart from and surrounding said pipe means for admitting and maintaining a liquid supply for said pipe means; and slidably adjustable valve means located between said pipe means and said screen means for adjusting the amount of surface area of said screen pipe subjected to said vacuum.

2. The wellpoint of claim 1 wherein said valve means comprises:

a valve member slidably mounted on said pipe means and shaped to conform to the space between said screen means and said pipe means; and means for maintaining said valve members in a selected position on said screen pipe.

3. The wellpoint of claim 1 wherein said screen means is a cylindrical, intermittently slotted pipe and said pipe means is cylindrical and concentric within said screen means and removable therefrom and wherein said valve means comprises:

an annular valve member slidably mounted on said pipe means and shaped to conform to the space between said pipe and screen means, said valve member having first and second chamfered edges abutting said pipe means;

a first O-ring mounted on said pipe means and against said first chamfered edge; and a second O-ring member mounted on said pipe means and against said second chamfered edge.

4. The wellpoint of claim 1 further including means for positioning said pipe means within said screen means and enabling manual removal of said pipe means from said screen means.

5. A wellpoint comprising:

a cylindrical screen pipe having a closed end for insertion into a well, an open end and openings formed intermittently on its length;

a cylindrical pipe member removably mounted on one end concentrically within said open end of said screen pipe and adapted to be connected with vacuum producing means on its other end;

an annular valve member slidably mounted on said pipe member and shaped to conform to the space between said screen and pipe member and having first and second chamfered edges abutting said pipe member;

a first O-ring mounted on said pipe member and against said first edge; and a second O-ring mounted on said pipe member and against said second edge.

6. In a wellpoint having an outer screen pipe for admitting and maintaining a supply of liquid and an inner vacuum producing pipe, the improvement comprising:

slidably adjustable valve means located between the outer screen pipe and the vacuum producing pipe for adjusting the amount of surface of said screen pipe subjected to said vacuum.

* * * * *